United States Patent [19]

Van Zandt

[11] 4,164,832

[45] Aug. 21, 1979

[54] TONGUE AND GROOVE STRUCTURE IN PREFORMED WALL SECTIONS

[76] Inventor: Alex Van Zandt, Rte. 5, Ada, Okla. 74820

[21] Appl. No.: 892,158

[22] Filed: Mar. 31, 1978

[51] Int. Cl.[2] ..... E04C 1/10

[52] U.S. Cl. ..... 52/593; 52/785

[58] Field of Search ..... 52/593, 595, 241, 785

[56] References Cited

U.S. PATENT DOCUMENTS

| | | | |
|---|---|---|---|
| 3,186,130 | 6/1965 | Gray | 52/595 |
| 3,292,321 | 12/1966 | Vander Schans | 52/241 X |
| 3,488,904 | 1/1970 | Schneller et al. | 52/241 |

*Primary Examiner*—J. Karl Bell

*Attorney, Agent, or Firm*—Laurence R. Brown

[57] ABSTRACT

Preformed wall sections having two spaced outer panels with interfitting tongue and groove structure disposed in opposite edges adjacent an outer panel are improved by construction of the tongue and groove to relieve the tendency to chip or damage the panel portion adjacent the groove if the panels are slightly misaligned when mating. Both the tongue and the groove structure is modified for achieving this improvement. The tongue is tapered away from the outer panel to form a wedge shaped portion for entering the groove. The groove has a strengthening member on the inner surface of the outer panel preferably comprising a layer of glue commonly used to glue a separating member to the outer panel but extending outwardly within the groove toward the edge of the panel.

3 Claims, 4 Drawing Figures

TONGUE AND GROOVE STRUCTURE IN PREFORMED WALL SECTIONS

Figure 1:
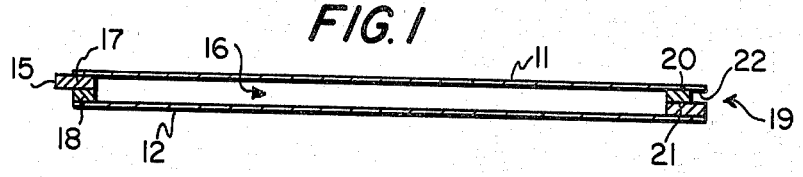

This invention relates to preformed wall sections and more particularly it relates to tongue and groove structure interlocking wall sections.

BACKGROUND OF THE INVENTION

Various types of preformed wall sections are known in the art which have two spaced panels and which are interfitted by tongue and groove structure in opposite edges of the panels. Representative panels and tongue groove structure of this type may be found described in one or more of the U.S. Pat. Nos. 1,859,667 Gruner; 2,021,577 Odell; 2,201,175 and 2,231,006 Harshberger; 2,342,682 Miller; 3,315,429 Swanson; 3,817,011 Weed; 3,349,528 Salt; 3,357,146 Gartrell; 3,449,879 Bloom; and 3,305,986 or 3,313,073 Mathews.

In the particular type of preformed wall section wherein two panels are spaced apart by spacing members at least on the opposing edges where the spacing members form the tongue and groove structure, and especially where the tongue and groove is offset in the spacing to lie adjacent one outer panel, there is a problem in interfitting the panels together without damage to the outer panel with an edge extending adjacent the groove. A typical preformed panel may be 96 inches high by 45 inches wide (2.44 M by 1.22 M) with a one inch (2.54 cm) thick tongue extending 1 ½ inches (3.81 cm). The outer panel may typically be ⅜ inch (0.95 cm) plywood and thus the tongue need tightly fit in interlocked position into the groove along the edge of the panel where the somewhat flexible plywood panel edge 1 ½ inches wide (3.81 cm) receives a significant portion of the entry force of the groove. Thus, only a very slight angular misalignment between two large panels can exert a force that tends to crack or chip the edge of the panel at the groove or to pull it away from the glue holding it to the separating member. The chipping is even more of a problem when the outer panel adjacent the groove is sheetrock, which is brittle and easily chips. It is readily seen that manual interlocking and fitting of such preformed wall sections can hardly take place without expectation of damage at the interfitting tongue-groove joint.

OBJECT OF THE INVENTION

It is therefore a principal object of this invention to improve the tongue and groove structure in preformed wall sections to reduce damage to the panels at the interfitting joints.

BRIEF DESCRIPTION OF THE INVENTION

Therefore in accordance with this invention, there is provided improved tongue and groove structure for preformed wall sections of the type formed with two spaced outer panels of plywood, sheetrock, or the like. To facilitate interlocking adjacent wall sections without damage or chipping to the panel member forming an outer groove boundary during slight misalignments of the panels while mating the tongue and groove structure is altered. Thus, the tongue is tapered on the outer side from near the panel and outwardly to its tip, so that it can enter the groove in a wedgelike manner to reduce forces tending to break or chip the panel edge adjacent the groove when two wall sections are not precisely in alignment. The groove is also altered by providing a strengthening member on the inner panel surface adjacent the groove extending inwardly under the spacing member between panels. The strengthening member in a preferred embodiment comprises a glue layer which is commonly used to glue the separating member to the outer panel.

THE DRAWING

Figure 2:
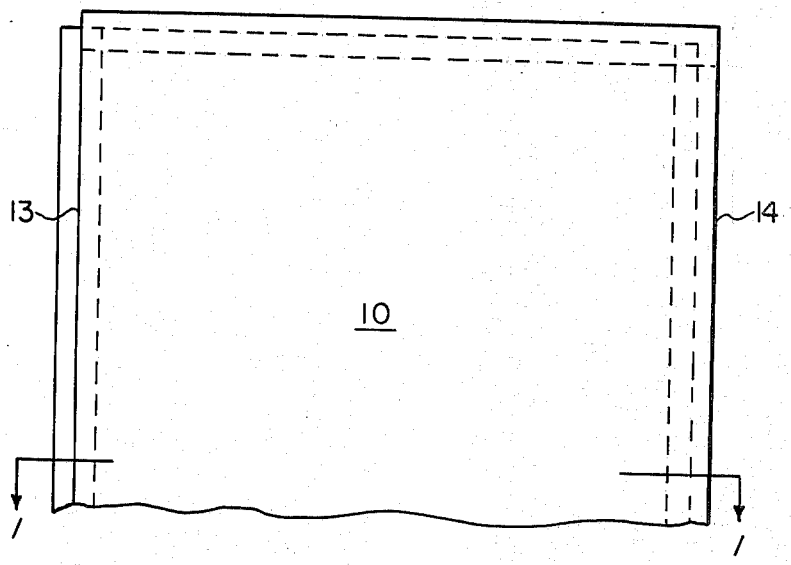
Figure 3:
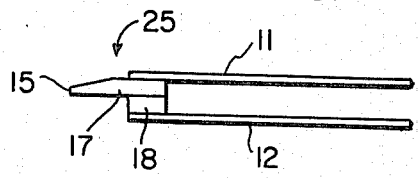
Figure 4:
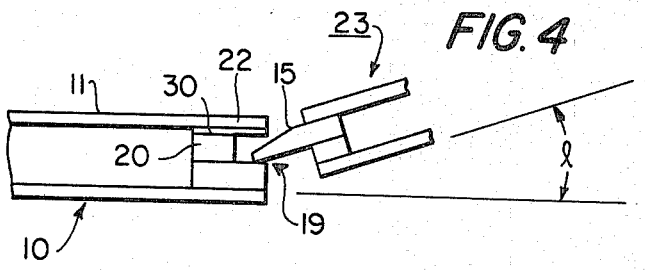

Other features, objects and advantages of this invention will be found throughout the accompanying detailed description which makes reference to the accompanying drawing, wherein:

FIG. 1 is a top view and FIG. 2 is a partial side view of a wall section incorporating the present invention, and FIGS. 3 and 4 are partial top views, enlarged in scale showing tongue and groove structure afforded by this invention.

THE DETAILED DESCRIPTION

Now with reference to the drawing, it is seen that preformed wall sections 10 comprise two outer panels 11 and 12 held apart a predetermined spacing distance by spacer members at least at two positions near the opposite panel edges 13, 14. These two spacers also form the tongue structure 15 extending from edge 13, with the tongue off center in the space 16 between the two panels 11, 12 and adjacent the outer panel 11. In a preferred form of construction the spacer is formed of two wooden strips 17, 18 glued together and glued to the outer panel 11 of exterior plywood and inner panel 12 of sheetrock, and having some insulation material filling the space 16.

Similarly the spacer of the opposite wall section edge 14 forms a groove structure 19, by means of two wooden strips 20, 21 glued in place and defined on the outermost wall by the lip 22 formed by the edge of the outer panel 11.

It may be visualized that for proper mating, close tolerances are provided for fitting tongue 15 into groove 19, and thus when adjacent panels 10 and 23 are placed side by side for mating, they need to be in almost perfect planar alignment to receive conventional type rectangular tongue structure into a rectangular groove configuration. This is difficult to maintain with large wall sections put into place manually and tends to stress, break, chip or mash the tip 22 of panel 11 overlapping the groove. Yet for purpose of economy necessary in this type of construction unit, it is not feasible to provide any extensive changes or to formulate a radically different way of mating side by side wall sections. FIGS. 3 and 4 therefore illustrate the manner in which minor structural changes can be made to the wall section tongue and groove structure to permit reasonable angular variation such as $\alpha$ in the mating of two adjacent sections without serious damage or chipping at the lip structure 22.

Accordingly the tongue strip 17 has its outer surface toward panel 11 tapered downwardly toward panel 12 from a position near the edge of panel 11 with a shortened flat seat 25 remaining for retaining a close tolerance fit with fully mated tongue-groove joints. This as seen in FIG. 4 aids the entry of tongue 15 into the groove without as much tendency to spread, chip or mash lip 22 about the groove when the wall sections 10 and 23 are misaligned for example by the angle $\alpha$ during mating.

Conversely in the groove 19, a strengthening structure 30 is provided to resist chipping, fracture and mashing of the lip 22 under force of the tongue in the mating act. This could be a metal or plastic strip, but is preferably according to this invention comprises a coating of the glue which bonds together the panel 11 and separator strip 20 which extends over into the groove to the inner surface of the panel member 11 at its tip 22. As shown the glue may also go around the end of the panel 11 to cover the exposed edge, also giving a protective coating against splintering or mashing when the tongue 15 is being forced into the groove 19.

It is therefore evident that this invention has very simply, conveniently and economically solved the problem of damage to wall sections of the aforesaid construction type during tongue and groove mating of sections side by side in place at the construction site. The invention is particularly necessary because the simplified construction of the wall panels uses the lip 22 as a boundary wall for groove 19 which is offset adjacent the upper panel 11 as is tongue 15, so that the angular mating tolerances of fitting conventional tongue and groove structure tend to damage the lip 22.

Having therefore improved the state of the art by the novel structural combination described hereinbefore, those features of novelty believed descriptive of the spirit and nature of the invention are set out with particularity in the appended claims.

What is claimed is:

1. The improved preformed wall section of the type having two outer panels separated from each other by a predetermined spacing distance with spacing members disposed between the panels on opposite panel edges wherein the spacers define tongue and groove edge joints on respective opposite panel edges which are offset between the panel spacing distance to lie adjacent one outer panel and including in the interlockable tongue and groove structure means for interfitting the tongue of one panel into the groove of an adjacent panel without damage to the outer panel edge at the groove if the panels are slightly misaligned during interfitting of the tongue into the groove, said means comprising a stiffener member located on the inner surface of the outer panel within said groove.

2. The wall section of claim 1 wherein said means comprises a tongue member tapered along its surface adjacent the outer panel from a position the panel edge and extending to the tip of the tongue.

3. The wall section of claim 1 wherein the stiffener member comprises a layer of glue extending between the space forming the groove and extending outwardly toward the edge of the outer panel on the inner surface thereof.

* * * * *